US009410322B1

(12) United States Patent
Du et al.

(10) Patent No.: US 9,410,322 B1
(45) Date of Patent: Aug. 9, 2016

(54) DAMPING SPLICE SLEEVE

(71) Applicant: Beijing University of Technology, Beijing (CN)

(72) Inventors: Xiuli Du, Beijing (CN); Zhiwei Jiang, Beijing (CN); Dechun Lu, Beijing (CN); Chengshun Xu, Beijing (CN); Qiang Han, Beijing (CN)

(73) Assignee: Beijing University of Technology, Beijing (CN)

( * ) Notice: Subject to any disclaimer, the term of this patent is extended or adjusted under 35 U.S.C. 154(b) by 0 days.

(21) Appl. No.: 15/095,371

(22) Filed: Apr. 11, 2016

Related U.S. Application Data

(63) Continuation of application No. PCT/CN2015/082962, filed on Jun. 30, 2015.

(30) Foreign Application Priority Data

Apr. 20, 2015 (CN) ..... 2015 1 0188924

(51) Int. Cl.
*E04C 5/16* (2006.01)

(52) U.S. Cl.
CPC ..... *E04C 5/165* (2013.01)

(58) Field of Classification Search
CPC ..... E04C 5/16; E04C 5/161; E04C 5/165; F16B 7/00; F16B 7/0426; F16B 7/182; Y10T 403/47; Y10T 403/472; Y10T 403/5733
See application file for complete search history.

(56) References Cited

U.S. PATENT DOCUMENTS 3,540,763 A * 11/1970 Yee ..... F16G 11/00 403/265
3,638,978 A * 2/1972 Guntermann ..... E04C 5/165 164/108
4,143,986 A * 3/1979 Antosh ..... E04C 5/165 403/307
4,469,465 A * 9/1984 Andrus ..... E04C 5/165 24/20 LS
4,666,326 A * 5/1987 Hope ..... E04C 5/165 403/13
4,960,009 A * 10/1990 Schultz ..... F16H 59/0208 403/224
5,347,881 A * 9/1994 Watson ..... F16H 59/0208 403/281
5,974,761 A * 11/1999 Mochizuki ..... E04C 5/165 403/267
7,032,286 B2 * 4/2006 Wang ..... B21K 1/56 29/508
7,878,730 B2 * 2/2011 Weaver ..... E04C 5/161 403/293
8,413,396 B2 * 4/2013 Oliva ..... E04C 5/165 403/305
2010/0031607 A1 * 2/2010 Oliva ..... E04C 5/165 52/848
2014/0147198 A1 * 5/2014 Kim ..... E04C 5/165 403/361
2014/0318704 A1 * 10/2014 Yamazaki ..... E04C 5/18 156/293

FOREIGN PATENT DOCUMENTS

CN 201420605446.2 1/2015

* cited by examiner

*Primary Examiner* — Daniel Wiley
(74) *Attorney, Agent, or Firm* — Tian IP & Technology, LLC.

(57) ABSTRACT

A damping splice sleeve may include an outer cylinder, a damping material, an inner cylinder. The outer cylinder is a hollow cylinder with partition. The partition divides the cylinder into two smaller cylinders. The two smaller cylinders have no connection with each other. Both ends of the outer cylinder are open. The inner cylinder includes two hollow cylinders with one end closed and the other end open. The damping material is installed between inner cylinder and outer cylinder. The damping splice sleeve can be used for the components' connections of precast building structures with vibration control requirements. When the load effects make the components have relative displacement, the damping material in the damping splice sleeve can have shear deformation and then dissipate energy.

1 Claim, 4 Drawing Sheets

DAMPING SPLICE SLEEVE

CROSS REFERENCE TO RELATED PATENT APPLICATIONS

This application is a continuation application of International application number PCT/CN2015/082962, filed Jun. 30, 2015, title "A DAMPING SPLICE SLEEVE" which claims the priority benefit of Chinese Patent Application Nos. 201510188924.3, filed on Apr. 20, 2015, which is hereby incorporated by reference in its entirety.

TECHNICAL FIELD

This present disclosure relates to a field of precast building structures and structural vibration control, and more particularly to a damping splice sleeve.

BACKGROUND

Target rebar connectors, including splice sleeves and mechanical connectors, have been widely used in connections of rebar between the prefabricated components. The rebar connectors have advantages including stably transferring the axial loads as well as being convenient and green construction. The vibrational reduction by damping is one of the most matured vibrational control methods. Dampers designed by damping vibration theory have been widely installed in varies building constructions all over the world. There are various types of material used in the dampers, including metal damping materials, polymers and their composites and viscous fluids etc.

The combination of splice sleeve and damping materials can form damping splice sleeves. Although the damping splice sleeve has a flexible stiffness as compared with the traditional fixed rebar connectors, it has excellent damping performance. The damping splice sleeves can turn fixed rebar connectors into numerous dampers, which can significantly increase the damping coefficient of whole building structures. In normal uses of building structures, the damping splice sleeves embedded in the components for vertical connections are mainly subjected to pressure effects. However, the damping splice sleeves are subjected to tension effects under seismic excitation and damping materials can yield and dissipate seismic energy prior to other building materials (concrete and rebar etc.) around sleeves. So these materials can remarkably reduce damage probability of prefabricated components by installing of damping splice sleeves. If the damping materials are hyper-elastic materials, precast structures can become a flexible damping system with partially self-centering functions.

Traditional rebar connectors have reliable tension properties. Nevertheless, mechanical properties of traditional rebar connectors under complex dynamic loading conditions are still unclear. Reports have shown that there are regional damages in connection of precast buildings when subjected to seismic excitation. The research of dynamic interactions between the rebar connectors and other building materials (e.g., concrete and rebar etc.) is at an initial stage. As a result, the existing technology for connections is not perfect. There is a need of a rebar connector that not only meets normal using requirement but also has advantages such as excellent vibrational control functions and being convenient and economic in constructions.

SUMMARY

The present disclosure relates to a damping splice sleeve, which connects rebar between the prefabricated components and enhance building structures' seismic performance.

A damping splice sleeve may include of: an outer cylinder, a damping material, an inner cylinder. The outer cylinder is a hollow cylinder with partition. The partition divides the cylinder into two smaller cylinders. The two smaller cylinders have no connection with each other. Both ends of the outer cylinder are open. The inner cylinder is two hollow cylinders with one end closed and the other end open. The damping material is installed between inner cylinder and outer cylinder.

In another embodiment, the damping splice sleeve may include of a middle cylinder. The middle cylinder is a hollow cylinder with one end closed and the other end open. There is also damping material between the middle cylinder and the outer cylinder.

As compared to the existed technology, the obvious advantages of the disclosure are as follow.

Implementations herein provides a damping splice sleeve. There is damping material between cylinders. The connection method for the inner cylinder uses existing technologies. When there is relative displacement between prefabricated components, there is relative displacement between an inner cylinder and an outer cylinder producing that is transmitted by the connected rebar. The relative displacement can make the damping material produce shear deformation dissipating the dynamic energy. The damping material can yield and dissipate the seismic energy prior to the building materials (concrete and rebar etc.), which can protect the building components from regional damage. The stiffness and damp of the damping material can be customized according to the dynamic characteristic of the building structures. Mechanical properties of the damping material also can be adjusted by the material type, geometrical features and the layers of the material. If the damping material is hyper-elastic material, the precast structures can turn to be flexible damping system with partially self-centering function. The damping splice sleeve has an easy configuration and can be an industrialized product.

BRIEF DESCRIPTION OF THE DRAWINGS

The detailed description is described with reference to the accompanying figures.

Figure 1:
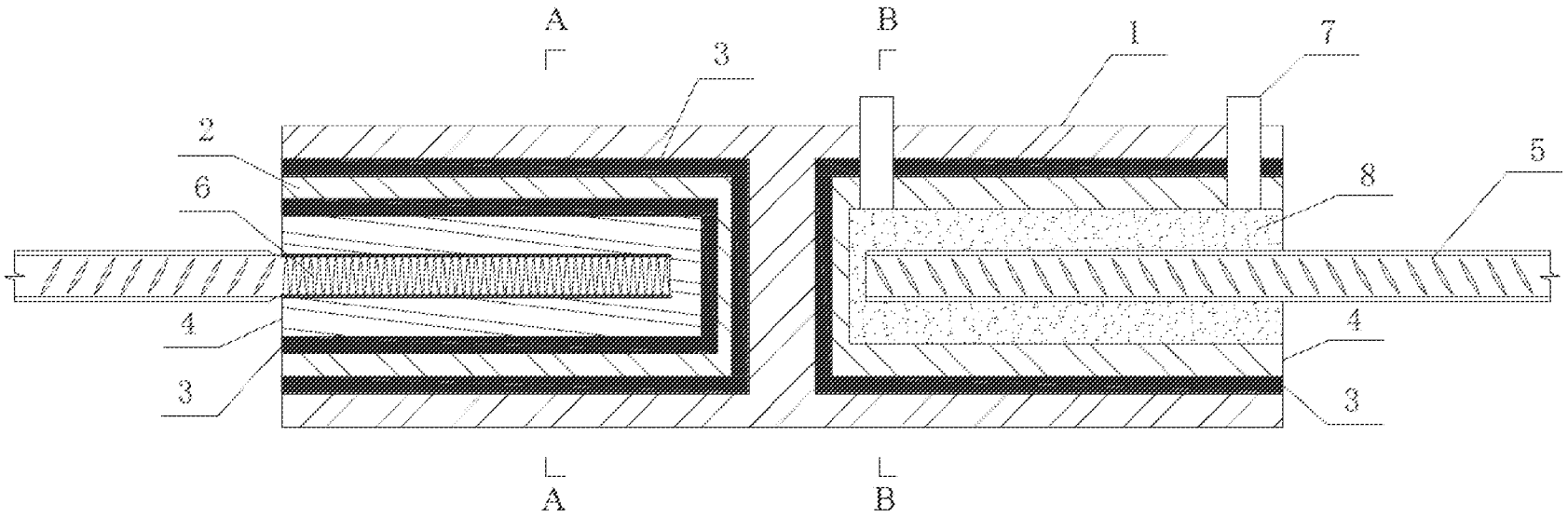
FIG. 1 is a schematic diagram of the damping splice sleeve.
Figure 2:
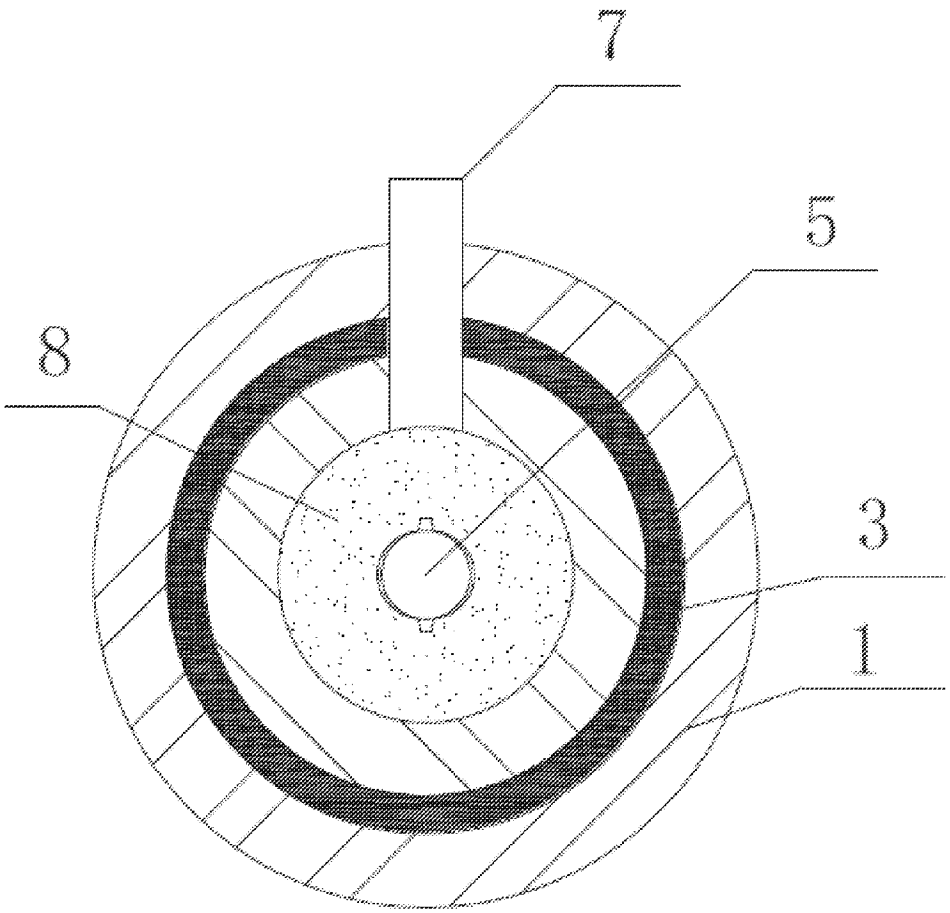
FIG. 2 shows a cross-sectional view as seen from Line B-B in FIG. 1
Figure 3:
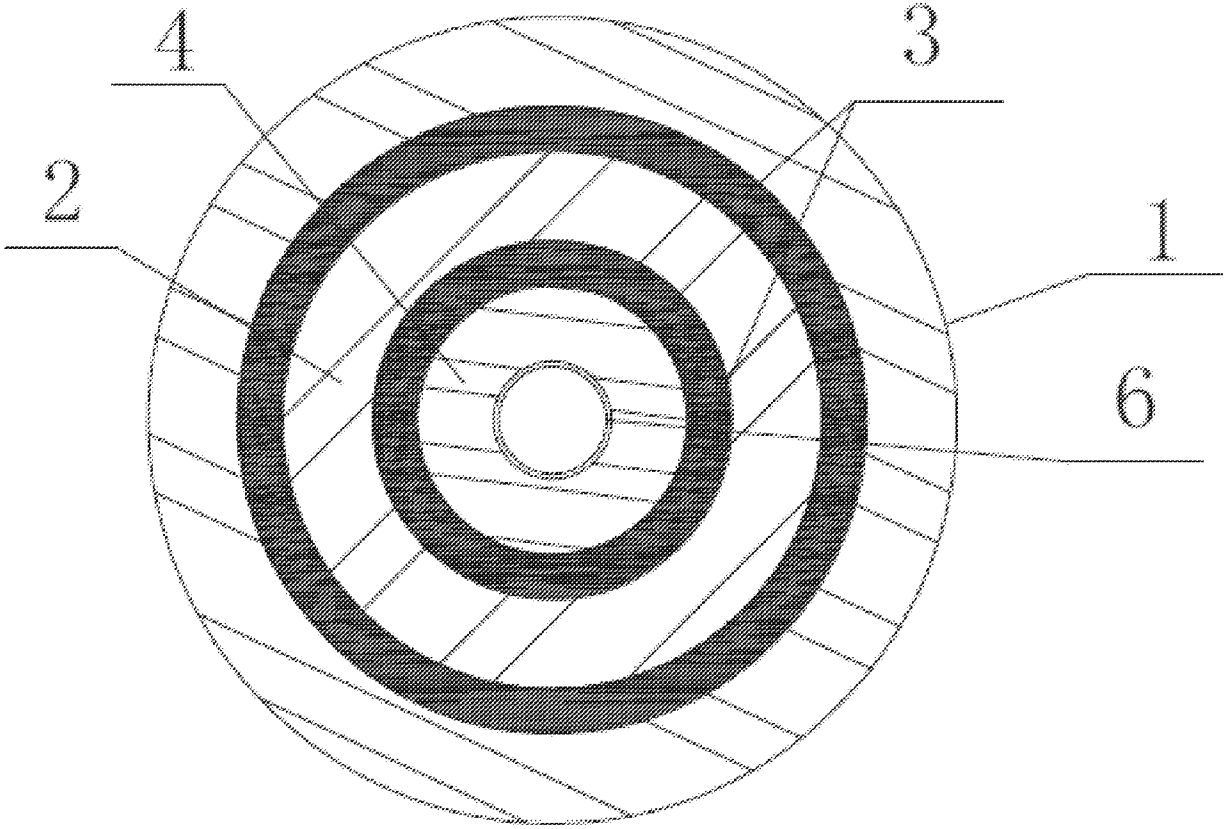
FIG. 3 shows a cross-sectional view as seen from Line A-A in FIG. 1
Figure 4:
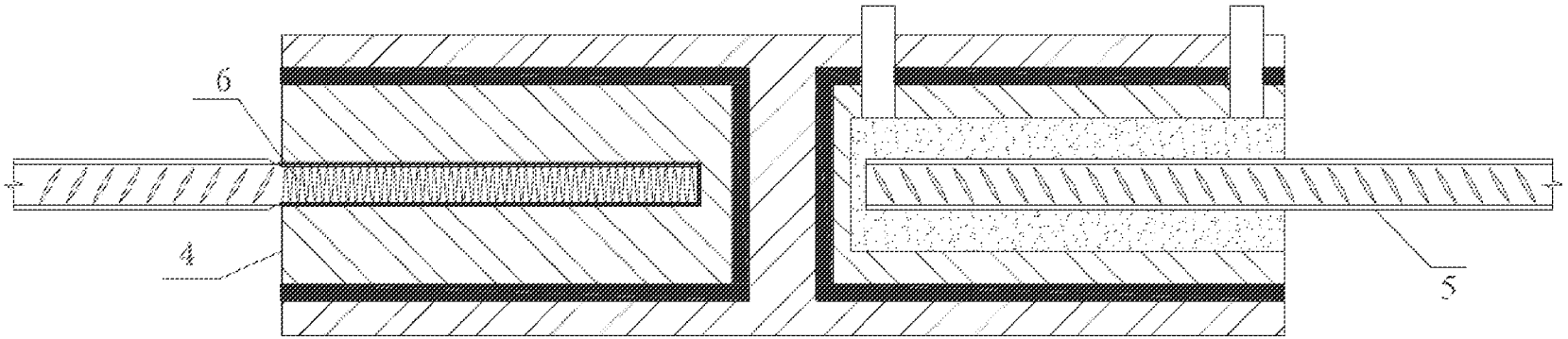
FIG. 4 is yet another schematic diagram showing the damping splice sleeve.

In the Figs, various numbers are used to indicate components as follow: outer cylinder (1), middle cylinder (2), damping material (3), inner cylinder (4), rebar (5), thread (6), grouting hole (7) and grouting material (8).

DETAILED DESCRIPTION

The following examples describe this present disclosure, but don't limit the coverage of the present disclosure.

When precast building structures have requirement of a vibration control, especially for the vertical connection, a damping splice sleeve can be used for the connection of the prefabricated components. Rebar can be put into the inner cylinder and then connected by mechanical or grouting methods. When there is relative displacement between prefabricated components, there is relative displacement between cylinders, which makes the damping material producing shear deformation and dissipating dynamic energy. This disclosure can be used not only in the connection of the new precast buildings but also in the seismic reinforcement of some existing buildings. As shown in FIG. 1, the damping splice sleeve may include of an outer cylinder (1), a middle cylinder (2), a damping material (3) and an inner cylinder (4). The partition divides the cylinder into two smaller cylinders. The two smaller cylinders have no connection with each other. Both ends of the outer cylinder are open. The inner cylinder is two hollow cylinders with one end closed and the other end open. The damping material is installed between inner cylinder and outer cylinder.

The outer cylinder (1) is a metal hollow cylinder with partition. The partition divides the cylinder into two symmetrical cylinders.

The inner cylinder (4) is metal hollow cylinder with one end closed and the other end open. The inner cylinder (4) can be completely put into the outer cylinder (1) from the two ends of the outer cylinder (1).

The damping material (3) is high performance damping material with a certain damping and stiffness. Damping material (3) is closely and tightly connected with the outer cylinder (1) and the inner cylinder (4).

In some implementations, damping material (3) can be polymer composites, nanometer materials, piezoelectric materials and metal or alloy materials, etc., which can provide sufficient stiffness and damp for the connector. The damping material (3) also should be temperature insensitive material with good durability.

This disclosure has various installation methods. As shown in FIG. 1, the inner cylinder can be made with thread as a parallel thread sleeve. The connected rebar (5) is also made with thread. The inner cylinder (4) and the rebar (5) are spliced by the thread. The inner cylinder (4) can also be designed as a grouted splice sleeve. Grout the grouting material (8) into the grouting hole (7) and the rebar is then connected to the inner cylinder (4).

This disclosure provides a damping splice sleeve for precast building structures with seismic problems. The damping splice sleeve is an idea of damping flexible system to enhance the seismic performance of the precast building structures, rather than just strengthen the stiffness of the connection. The damping splice sleeve maybe have self-centering function with appropriate damping material, which can make the precast building continue to be used after earthquake excitation. The damping splice sleeve has simple configuration and can be industrially produced and installed.

This disclosure can also be combined with other energy dissipation technology for further seismic performance of the precast building structures.

What is claimed is:

1. A damping splice sleeve comprising:

an outer cylinder, comprising a hollow cylinder with a partition therein that divides the outer cylinder into two opposing smaller cylinders, each with a closed end adjacent the partition, and an open end opposite the closed end thereof;

a middle cylinder within one of the two smaller cylinders of the outer cylinder, the middle cylinder comprising a closed end adjacent the partition, and an open end opposite the closed end thereof;

a first inner cylinder within the middle cylinder, the first inner cylinder comprising a closed end adjacent the partition, and an open end opposite the closed end thereof; and a damping material installed between the outer cylinder and the middle cylinder, and between the middle cylinder and the first inner cylinder;

wherein a first rebar is connected within the open end of the first inner cylinder.

* * * * *